United States Patent [19]

Claessens et al.

[11] Patent Number: 4,959,586

[45] Date of Patent: Sep. 25, 1990

[54] ELECTRIC INCANDESCENT LAMP

[75] Inventors: Stephanus J. Claessens; Laurent H. T. Demets, both of Turnhout, Belgium

[73] Assignee: U.S. Philips Corporation, New York, N.Y.

[21] Appl. No.: 350,825

[22] Filed: May 11, 1989

[30] Foreign Application Priority Data

May 24, 1988 [NL] Netherlands ..... 8801325

[51] Int. Cl.[5] ..... H01K 1/18

[52] U.S. Cl. ..... 313/273; 313/279

[58] Field of Search ..... 313/273, 279

[56] References Cited

U.S. PATENT DOCUMENTS

| | | | |
|---|---|---|---|
| 3,416,024 | 12/1968 | Young | 313/273 |
| 3,758,807 | 9/1973 | Opde Beeck | 313/273 |
| 3,943,395 | 3/1976 | Huston et al. | 313/273 |
| 4,052,637 | 10/1977 | Op de Beeck | 313/279 X |
| 4,272,698 | 6/1981 | Oyama et al. | 313/273 X |

FOREIGN PATENT DOCUMENTS

| | | |
|---|---|---|
| 8014413 | 11/1980 | Fed. Rep. of Germany . |
| 77192 | 6/1975 | Japan . |
| 151494 | 11/1975 | Japan . |

*Primary Examiner*—Sandra L. O'Shea

*Attorney, Agent, or Firm*—Robert J. Kraus

[57] ABSTRACT

The electric incandescent lamp has a filament (2) comprising light-emitting sections (5,6,7) and non-light-emitting sections (8,9) integral therewith. A non-light-emitting section (9) has at its two ends a helically wound portion (10,11), which portions are interconnected by the tungsten wire (3) from which the filament (2) is wound. An additional tungsten wire (14) extends along the non-light-emitting section (9) and is wound around each of its helically wound portions (10,11). The incandescent lamp has a filament (2) of a simple construction, whose manufacture can readily be mechanized.

2 Claims, 1 Drawing Sheet

ELECTRIC INCANDESCENT LAMP

BACKGROUND OF THE INVENTION

The invention relates to an electric incandescent lamp comprising

- a tubular glass lamp vessel sealed in a vacuum-tight manner,
- a filament of tungsten wire longitudinally arranged in the lamp vessel,
- current supply conductors extending through the wall of the lamp vessel to the filament,
- which filament has several helically wound light-emitting sections, which are interconnected by non-light-emitting sections integral with the light-emitting sections, a non-light-emitting section having at its two ends a respective helically wound portion, which portions are interconnected by the tungsten wire,
- an additional metal wire interconnecting the helically wound portions and a respective support bearing against the wall of the lamp vessel being present on said portions.

Such an incandescent lamp is known from DE GM 8 014 413.

An incandescent lamp of the kind mentioned can be used as a photocopying lamp. The variety of light-emitting and non-light-emitting sections has for its object to irradiate, to illuminate or to heat, uniformly throughout its width the article to be irradiated, an original or a copy made. With a lamp having a filament wound throughout its length with the same pitch this is not possible. At its edges the article would receive less radiation than halfway between the edges.

In a filament having light-emitting sections and non-light-emitting sections, the non-light-emitting sections could consist of one or more turns of very high pitch. These turns remain comparatively cold due to their very high pitch and consequently emit little radiation. If such a non-light-emitting section has a fairly great length, however, it nevertheless dissipates comparatively much energy and the efficiency of the lamp is low.

In order to obtain a lamp of comparatively high efficiency, numerous proposals have been made.

U.S. Pat. No. 3,416,024 discloses a lamp in which the filament is assembled by screwing light-emitting helically wound parts onto rod-shaped non-light-emitting parts. In the rod-shaped parts, the current density and hence the dissipation is low. The manufacture of this filament is time-consuming and expensive, however, because it requires much manual labour.

JP UM 151494/75 discloses a lamp having a filament, in which the non-light-emitting section is a straight wire portion, onto one end of which a metal wire is wound, which extends along said straight wire portion to its other end, is wound around it and is then spiralled out as a support. The non-light-emitting part is therefore bridged by an additional wire, as a result of which the electrical resistance is smaller.

A disadvantage of this known filament is that operations must be carried out on the slack assembly of light-emitting sections and straight intermediated portions to provide the bridging wire without deformations of the filament being obtained. The manufacture of this known filament is also time-consuming and expensive and requires much manual labour.

In the filament according to JP UM 77192/75, a non-light-emitting section consists of a straight portion of the winding wire, which has at both ends a number of turns. After the mandrel onto which the filament was wound had been removed, a straight wire bridging the non-light-emitting section is inserted into these turns. The wire is fixed on the turns by each time winding a support onto these turns.

The manufacture of this filament also requires very much manual labour and the manipulation of a body with vulnerable helically wound sections.

With respect to these known constructions, in which during the manufacture of the filament many constructive operations have to be carried out by hand on slack and vulnerable parts, the construction according to the aforementioned DE GM has the great advantage that all the constructive operations can be carried out mechanically on the filament while it is still strengthened by a winding mandrel.

According to the aforementioned DE GM, a tungsten wire is wound in accordance with the desired pattern around a molybdenum mandrel, after which supports are wound onto the filament. The filament then need no longer be subjected to any constructive operation. A protective layer is then formed on the portions of the filament which have to be non-light-emitting, after which the winding mandrel in the remaining portions is removed by dissolving it in an acid bath. Subsequently, the protective layer around the non-light-emitting portions is dissolved. The remainder of the winding mandrel is then present in these portions as a bridging wire.

This known filament has the great advantage that it can entirely be manufactured by machine. However, a disadvantage is that additional manufacturing steps deviating from normal production methods, i.e. providing and later removing the protective layers, have to be carried out.

SUMMARY OF THE INVENTION

The invention has for its object to provide an electric incandescent lamp of the kind described in the opening paragraph, whose filament has a simple construction, whose manufacture can readily be mechanized.

According to the invention, this object is achieved in that the additional wire is a tungsten wire extending along the non-light-emitting section and is wound around each of the helically wound portions thereof.

During the manufacture of the filament of the electric incandescent lamp according to the invention, a tungsten wire is wound according to the desired pattern of turns onto a winding mandrel. Subsequently, the additional wire is arranged and the filament is provided with supports. The assembly is then heated, for example, in a furnace to eliminate winding stresses in the filament. The winding mandrel is then removed in an acid bath. The filament is then entirely ready.

In an embodiment, the lamp according to the invention has an additional wire extending from at least one end of the relevant helically wound portion of the non-light-emitting section, as a support for the filament, to the wall of the lamp vessel.

The construction of the filament of the lamp according to the invention further has a few great advantages with respect to other constructions.

A wire can generally not be wound tightly around a mandrel having the same diameter as or a smaller diameter than the wire itself. In the filament of the lamp according to the invention, the additional wire is wound around turns on a winding mandrel. It is then also possible to use for the additional wire a comparatively thick wire so that the non-light-emitting section has a low electrical resistance. This is in contrast with the construction according to the aforementioned JP UM 151494/75, in which the additional wire is wound around a straight portion of the comparatively thin filament wire itself. Due to the fact that in the lamp according to the invention the additional wire can be provided while the winding mandrel is still present in the turns of the filament, the additional wire can be tightly wound and can even be pulled between the turns of the non-light-emitting section. As a result, a low contact resistance can be obtained. The turns of the non-light-emitting section provide grip for the additional wire. Also in this respect, the construction according to the aforementioned JP UM is of lower quality.

BRIEF DESCRIPTION OF THE DRAWING

An embodiment of the electric incandescent lamp according to the invention is shown in the drawing. In the drawing.

DESCRIPTION OF THE PREFERRED EMBODIMENT

Figure 1A:
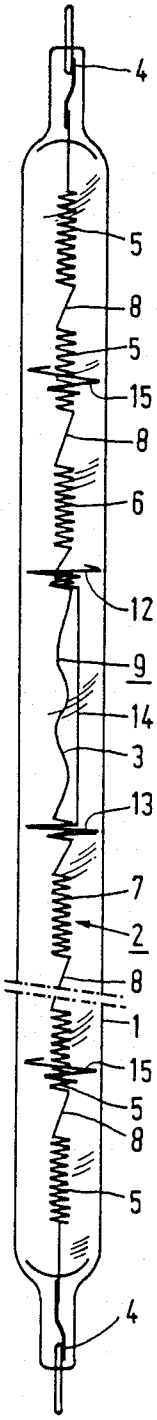
FIG. 1*a* is a side elevation of a lamp.

The lamp has a tubular glass lamp vessel 1 sealed in a vacuum-tight manner and consisting in the embodiment shown of quartz glass. A filament 2 of tungsten wire 3 is longitudinally arranged in the lamp vessel 1. Current supply conductors 4 extend through the wall of the lamp vessel 1 to the filament 2. The filament 2 has several helically wound light-emitting sections 5, 6, 7, which are interconnected by non-light-emitting sections 8, 9 integral with the light-emitting sections.

Figure 1B:
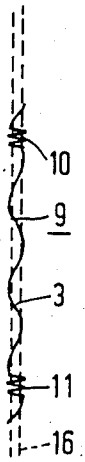
FIG. 1*b* shows a portion of the filament of FIG. 1*a*.
Figure 1C:
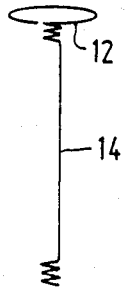
FIG. 1*c* shows the additional wire of FIG. 1*a*.
Figure 1D:
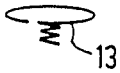
FIG. 1*d* shows a support of FIG. 1*a*.

A non-light-emitting section 9 has at its both ends a respective helically wound portion 10, 11, as shown in FIG. 1*b* for illustration, which parts are interconnected by the tungsten wire 3 from which the filament 2 is wound. An additional wire 14 also interconnects the helically wound portions 10, 11. A respective support 12, 13 bearing against the wall of the lamp vessel 1 is present on these portions 10, 11. The additional wire 14, shown separately for illustration in FIG. 1*c*, according to the invention is a tungsten wire extending along the non-light-emitting section 9 and is wound around each of its helically wound portions 10, 11. In the drawing (see also FIG. 1*c*), the additional wire 14 extends at one end from the relevant helically wound portion 10 of the non-light-emitting section 9 as a support 12 for the filament 2 to the wall of the lamp vessel 1.

The filament 2 has a simple construction, whose manufacture can be readily mechanized.

In manufacturing the filament the tungsten wire 3 is wound according to a predetermined pattern onto a winding mandrel 16 (FIG. 1*b*), for example of molybdenum. Still in the presence of the winding mandrel, the additional wire 14 is arranged, which may extend at one or at both ends as a future support to a greater distance from the winding mandrel. Supports 13, 15 can be provided on the filament, as is common practice. However, the support 13 may alternatively be integral with the additional wire 14. The filament on the winding mandrel 16 still present is heated to eliminate winding stresses. The winding mandrel is then removed, for example by dissolving it, as is usual, in acid. The filament is then ready. The additional wire 14 bridges the non-light-emitting section 9, which has a comparatively great length and which would dissipate comparatively much energy without the presence of the wire 14.

What is claimed is:

1. An electric incandescent lamp comprising:

a. an elongated, light transmissive envelope sealed in a vacuum tight manner;

b. first and second conductors extending through respective portions of the envelope;

c. a continuous tungsten wire filament extending longitudinally in the envelope from the first conductor to the second conductor, said filament forming at least first and second helically wound light-emitting sections and a non-light-emitting section for spacing apart said first and second light-emitting sections, said non-light-emitting section having first and second helically wound portions formed at opposite ends thereof;

d. an additional tungsten wire extending longitudinally in the envelope adjacent the non-light-emitting section and having first and second helically wound portions formed at opposite ends thereof, said helically wound portions being wound around the respective helically wound portions of said non-light-emitting section; and e. means for supporting the filament in the envelope at said helically wound portions of the additional tungsten wire.

2. An electric incandescent lamp as in claim 1 where the means for supporting the filament in the envelope comprises a portion of at least one end of the additional tungsten wire which extends to an inner surface of the envelope.

* * * * *